US006986676B1

(12) United States Patent
Tronolone et al.

(10) Patent No.: US 6,986,676 B1
(45) Date of Patent: Jan. 17, 2006

(54) MULTI-CHANNEL HIGH DEFINITION VIDEO INTERCONNECT

(76) Inventors: James Tronolone, 56 Cedar Rd., Ringwood, NJ (US) 07456; Leandro Blanco, 53 Lake Dr., Byram Township, NJ (US) 07874

( * ) Notice: Subject to any disclaimer, the term of this patent is extended or adjusted under 35 U.S.C. 154(b) by 0 days.

(21) Appl. No.: 11/190,786

(22) Filed: Jul. 27, 2005

Related U.S. Application Data

(60) Provisional application No. 60/591,961, filed on Jul. 29, 2004.

(51) Int. Cl.
*H01R 13/64* (2006.01)

(52) U.S. Cl. ..... 439/247; 439/540.1; 439/701

(58) Field of Classification Search ..... 439/247, 439/540.1, 701, 579
See application file for complete search history.

(56) References Cited

U.S. PATENT DOCUMENTS

| | | | | |
|---|---|---|---|---|
| 3,072,340 | A * | 1/1963 | Dean | 439/701 |
| 4,915,641 | A * | 4/1990 | Miskin et al. | 439/247 |
| 5,328,388 | A * | 7/1994 | Fust et al. | 439/540.1 |
| 5,545,053 | A * | 8/1996 | Ishii et al. | 439/701 |
| 6,582,256 | B2 * | 6/2003 | Sakurai et al. | 439/701 |
| 6,623,309 | B2 * | 9/2003 | Sakurai et al. | 439/701 |
| 6,666,728 | B2 * | 12/2003 | Ichida et al. | 439/701 |

* cited by examiner

*Primary Examiner*—Tho D. Ta
(74) *Attorney, Agent, or Firm*—Clifford G. Frayne

(57) ABSTRACT

A transmission assembly for remote or fixed applications which allows the transmission of high definition video via multiple 75 ohm high definition video coaxial signals in one cable assembly, the cable assembly having 75 ohm coaxial connectors for interconnect with a similar cable assembly, the 75 ohm coaxial connectors being housed in G-block style housings at each end of the cable assembly, the G-block style housings having locking latches secured thereto to insure the connection and prevent inadvertent or unintended disconnect.

4 Claims, 5 Drawing Sheets

MULTI-CHANNEL HIGH DEFINITION VIDEO INTERCONNECT

RELATED APPLICATIONS

Applicant claims the benefit of provisional application Ser. No. 60/591,961, filed Jul. 29, 2004.

BACKGROUND OF THE INVENTION

1. Field of the Invention

The present invention relates to high definition video systems, and in particular to an apparatus and method which allows the transmission of multiple 75 ohm high definition video coaxial signals in one cable assembly using 75 ohm coaxial connectors.

2. Description of the Prior Art

The advent of high definition video systems has led to some problems in the ability to send multiple high definition video signals in a single cable assembly. Multiple coaxial cable assemblies which have been used in the past to transmit video signals normally contained 50 ohm or non rated cables and contacts which are not capable of high definition video transmission. The advent of high definition video systems, particular from remote or fixed locations which requires the interconnection of cables, there was a need for 75 ohm coaxial cable and connectors. Still further, there was a need to house the connections in an assembly which was easily secured to a like type assembly so that the necessary distance could be traversed for the remote or fixed application. Still further, the connectors had to be securable in a way that insured that there would be no inadvertent or unattended disconnect.

OBJECTS OF THE INVENTION

An object of the present invention is to provide for the transmission of multiple 75 ohm high definition video coaxial signals in one cable assembly using 75 ohm coaxial connectors.

A further object of the present invention is to provide for a novel transmission system of multiple 75 ohm high definition video coaxial signals in one cable assembly with 75 ohm coaxial connectors which secure a connection between cable assemblies and prevents inadvertent or unintended disconnects.

A still further object of the present invention is to provide for a multi-channel high definition video interconnect for remote or fixed applications which would have application to high definition video, standard definition serial digital video, digital audio and high resolution analogue video applications.

SUMMARY OF THE INVENTION

A transmission assembly for remote or fixed applications which allows the transmission of high definition video via multiple 75 ohm high definition video coaxial signals in one cable assembly, the cable assembly having 75 ohm coaxial connectors for interconnect with a similar cable assembly, the 75 ohm coaxial connectors being housed in G-block style housings at each end of the cable assembly, the G-block style housings having locking latches secured thereto to insure the connection and prevent inadvertent or unintended disconnect.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
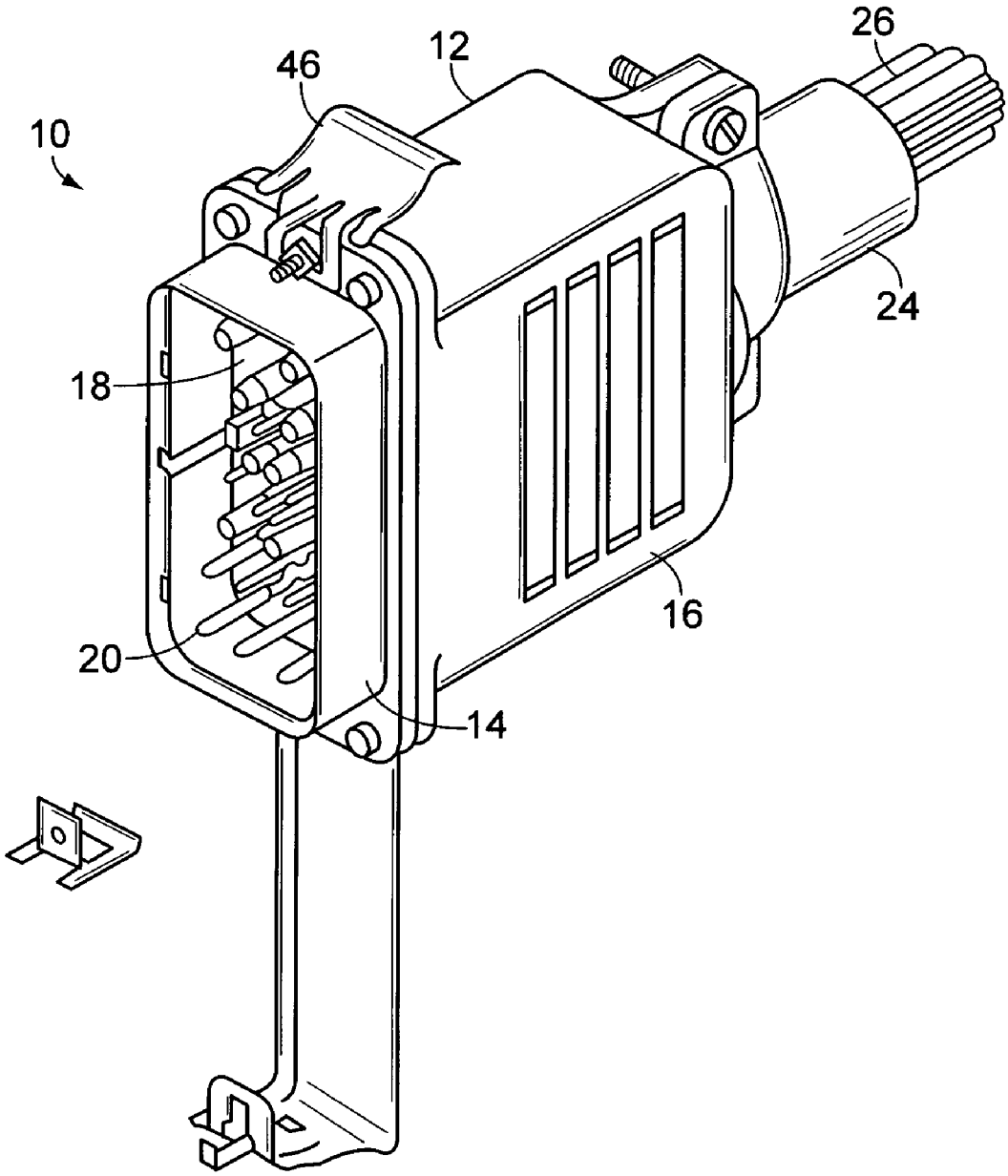
FIG. 1 is a perspective view of a male connector of a coaxial cable assembly of the present invention.

FIG. 1 is a perspective view of a male connector 10 of a 75 ohm high definition video coaxial signal cable assembly of the present invention. The male connector 10 comprises a shell connector 12 which consists of a housing 14 and a rear retainer 16. Housing 14 and rear retainer 16 are secured by an appropriate securing means, such as a threaded fastener. The male socket modules 18 are secured within housing 14 and rear retainer 16 and positioned such that the modules 18 are recessed within the housing 14 so as to protect the male contacts 20 which protrude from the socket modules 18 exposing the actual contacts. Formed on housing 14 would be a polarizing rib 22 which ensures proper connection with a female connector as described hereafter. Secured to the rear of the shell connector 12 would be a cable housing 24 within which there are multiple 75 ohm transmission cables 26 which would terminate within housing 14 with respective 75 ohm male connector 20.

Figure 2:
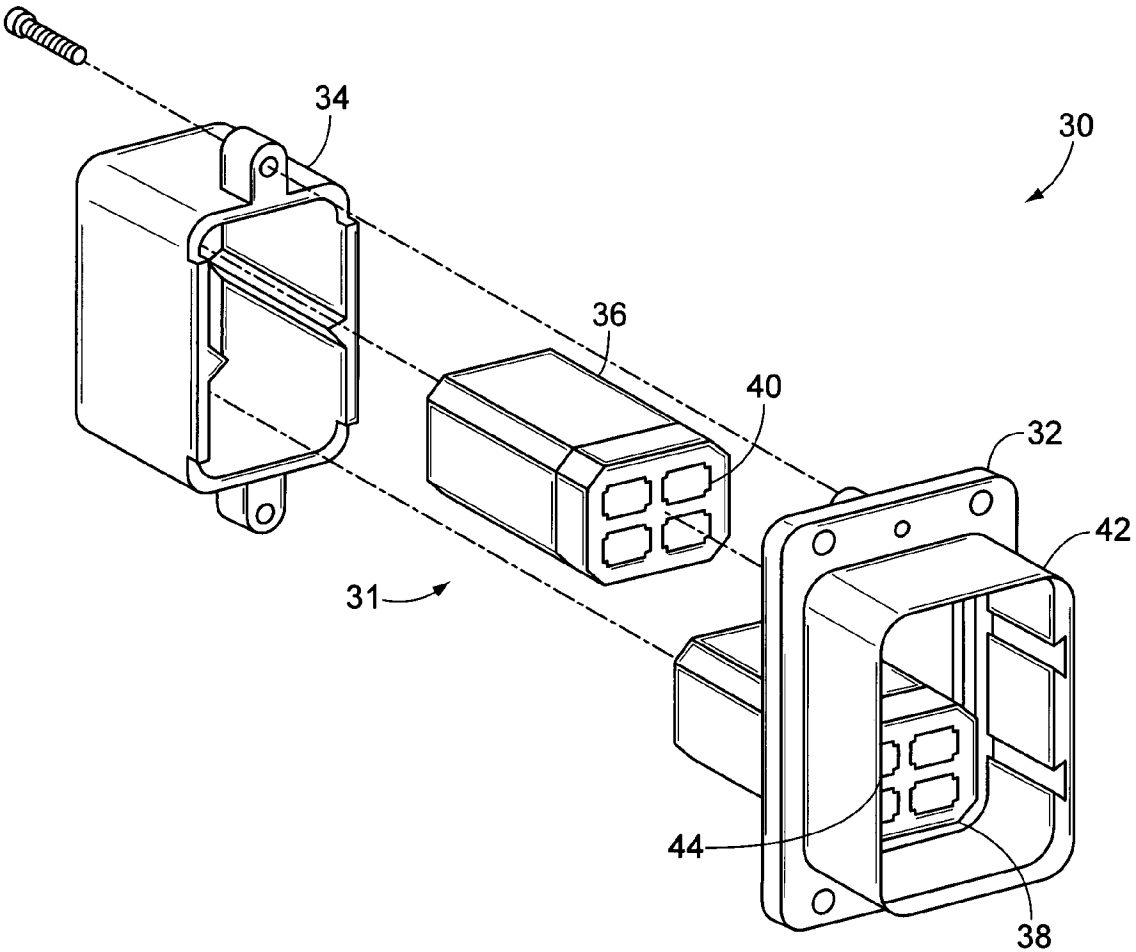
FIG. 2 is a perspective exploded view of a female connector of a coaxial cable assembly of the present invention.

FIG. 2 is an exploded perspective view of a female connector 30 of a 75 ohm high definition video coaxial signal cable assembly. Female connector 30 comprises a housing 32 composed of a shell connector (not shown) and a rear retainer 34 secured in a suitable fashion for instance by threaded fastener. Positioned within housing 32 are a plurality of pin modules 36 having female contacts 38 on their front face 40. The front face 40 of the plurality of pin modules 36 is positioned flush with the front opening 42 of the front housing 32. The front housing 32 also has a polarizing slot 44 for alignment and slidable receipt of a polarizing rib on the male connector 10. Male connector 10 and female connector 30 would also have cooperable locking or retaining clips 46 on either their opposing side walls or on their top wall and bottom wall for securing male connector 10 and female connector 30. It should also be noted that female connector 30 when mated with male connector 10 encompasses the housing 14 as opposed to the usual circumstance where the male connector encapsulates the female connector. The housing 14 of the male connector 10 and the housing 32 of female connector 30 when separated allow for the socket modules 36 and pin modules 18 to be retained within the respective housing, yet allow them to float in the housing to aid in the alignment of the male and female contacts when the housings are reconnected.

The pin modules in the male connector are designed to be recessed within the connector housing to protect the male contacts 20 which protrude from the pin module 18. This feature allows for the housing to align before the male contact 20 and female contact 28 to make contact thereby protecting the contacts from misalignment and damage. In the case of high definition video, the alignment and condition of the contacts are much more important than in standard definition video because the data rates are running at such higher frequency. Misalignment or damage to the contacts can cause degradation to the signal, thus increasing return loss and impedance mis-matches.

Figure 3:
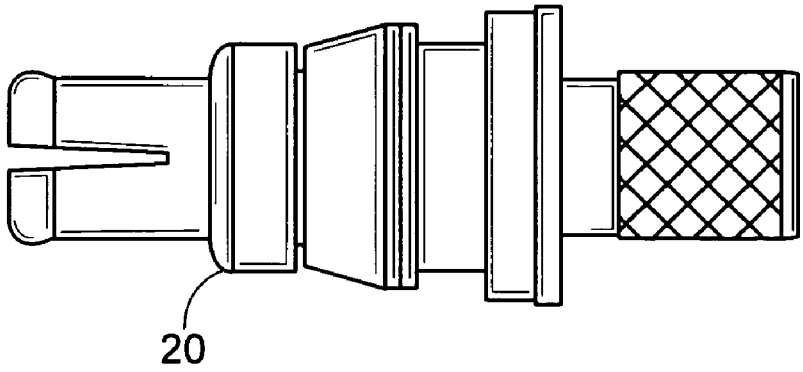
FIG. 3 is a side view of a male contact.
Figure 4:
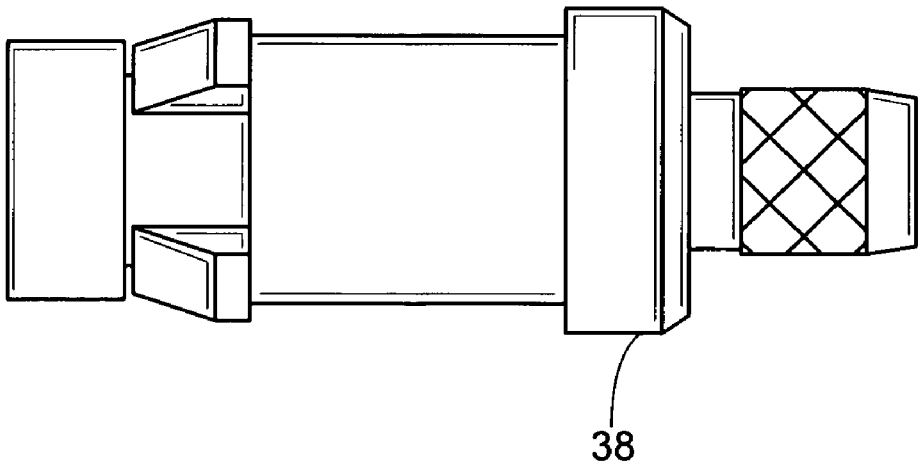
FIG. 4 is a side view of a female contact.

FIG. 3 is a side view of a male contact 20 of the present invention, and FIG. 4 is a side view of female contact 38.

Within each male and female housing, there are respective male and female modules 18 and 36. The modules can be configured with any combination of either unbalanced coaxial contacts or twisted pair audio contacts commonly associated with high definition video. The modules are held in place in the housing, but are allowed to float to aid in alignment of the male/female connections.

Figure 5:
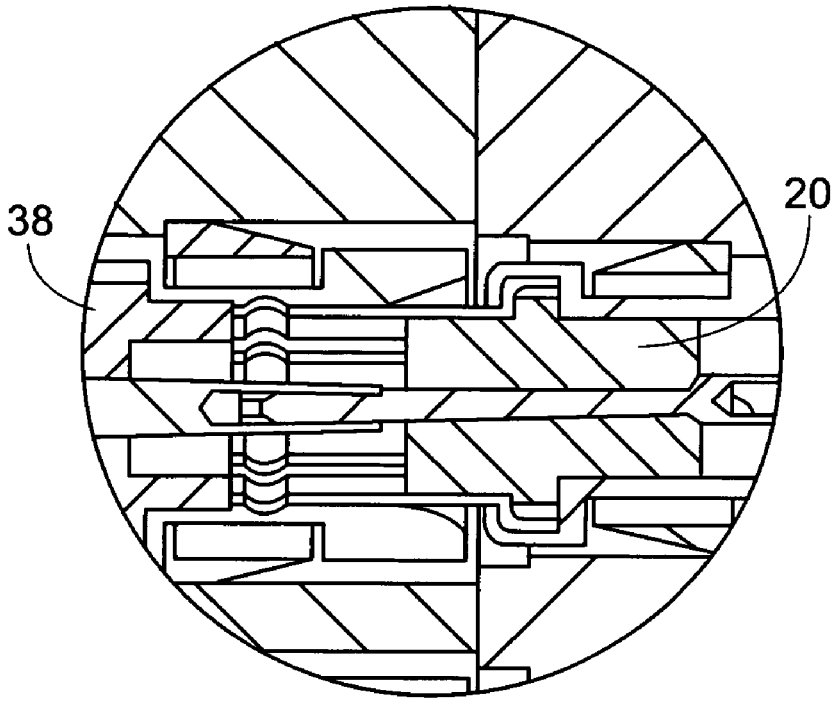
FIG. 5 is a cross section of joinder of a male contact and female contact.

FIG. 5 is a partial cross section of the male/female contacts 20 and 38 secured together illustrating the manner in which the male contacts 20 and the female contacts 38 engage. The design of the male and female housings, and the male and female connector blocks allow the housings to align before the male contacts and female contacts make contact thereby protecting the contacts from misalignment and damage. In high definition video, the alignment and condition of the male and female contacts are much more important than in standard definition video because the data rates are running at much higher frequency. Misalignment or damage to the contacts can cause degradation to the signal, thus increasing return loss and impedance mis-matches.

The contacts are 75 ohm mcx type connectors. They are formed with a locking mechanism so as to snap fit into the respective connector modules. They are designed so that they can be removed from the blocks with a removal tool, yet simply inserted into the connector blocks with a slight push into place. The connectors are specifically designed to pass the 75 ohm high definition video signal.

Figure 6:
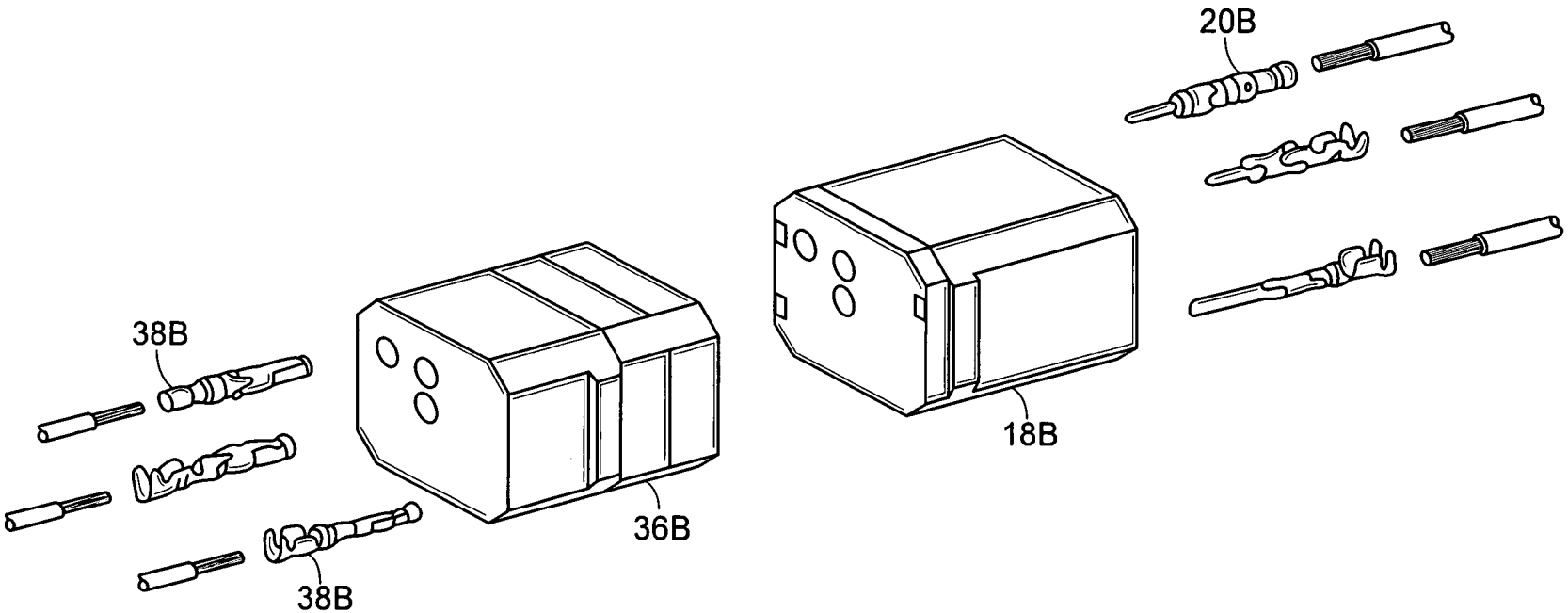
FIG. 6 is a perspective view of an assembly of the present invention in which twisted pair contacts are utilized.

FIG. 6 illustrates an exploded view of a connector utilizing twisted pair contacts, male contacts 20B and female contacts 38B secured to respective wires and secured within modules 18B and 36B. The coaxial contacts are designed to work with commonly available high definition coaxial cable.

An example of a housing that could be utilized in this application is the amp G block type 14 but other connector housings and shells could be similarly adapted for use with the high definition video contacts disclosed herein.

The male/female connector housings are designed to daisy chain 75 ohm mcx type cable so as to provide for high definition video from remote or fixed locations. However, the connector housings and connectors disclosed herein can be mounted at a cable end, a panel mount, an equipment back panel or any combination thereof without departing from the spirit and scope of the invention.

While the cable assembly has been developed to address problems associated with the advent of high definition video systems and the need to transmit multiple coaxial signals in one cable assembly from remote locations, the structure of the cable assembly will allow it to be used for the remote or fixed transmission of standard definition serial digital video, digital audio and high resolution analogue video.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

We claim:

1. A multi-channel high definition video interconnect comprising:

a male connector defined by a housing member having secured therein a plurality of modules having protruding male contacts, said modules disposed in said housing member such that said protruding male contacts are recessed within said housing member, said male connector secured to a cable having multiple 75 ohm high definition video coaxial cables for the transmission of 75 ohm high definition video coaxial signals, said coaxial cables in communication with said male contacts in said contact module;

a female connector comprising a housing member securing therein a plurality of female receptor modules, said female receptor modules positioned within said housing member so as to present a front face of said module in a plane with a front face of said female connector, said female connector in communication with a transmission cable having multiple 75 ohm high definition video coaxial cables therein for transmitting multiple 75 ohm high definition video coaxial signals wherein said modules having protruding male contacts and said female receptor modules are secured within their respective housing members and float therein to assure alignment with each other before said male connectors contact said female connectors, thereby protecting said male contacts from misalignment and damage;

a securing means for securing said male connector to said female connector.

2. The multi-channel high definition video interconnect in accordance with claim 1 wherein said male connectors and said female connectors are interconnected in a daisy chain manner to provide for the transmission of multiple 75 ohm high definition video coaxial signals.

3. The multi-channel high definition video interconnect in accordance with claim 1 wherein said female connector when secured to said male connector encapsulates said male connector front face and housing to insure connector alignment before mating.

4. The multi-channel high definition video interconnect in accordance with claim 1 wherein said male connector and said female connector are keyed to allow insertion in only one direction.

* * * * *